United States Patent [19]

Swain

[11] 4,061,133

[45] Dec. 6, 1977

[54] COMBINATIONAL FIREPLACE UNIT

[76] Inventor: Samuel J. Swain, 824 Dixie St., Carrollton, Ga. 30117

[21] Appl. No.: 635,422

[22] Filed: Nov. 26, 1975

[51] Int. Cl.[2] ..... F24H 1/44

[52] U.S. Cl. ..... 126/350 R; 126/133; 431/125; D23/106

[58] Field of Search ..... 126/350 R, 127, 120, 126/133, 92 R, 5; 431/125; D23/106

[56] References Cited

U.S. PATENT DOCUMENTS

| | | | |
|---|---|---|---|
| Re. 5,278 | 2/1873 | Mershon | 126/350 |
| 374,649 | 12/1887 | Backus | 126/133 |
| 563,005 | 6/1896 | Backus | 126/127 |
| 1,131,020 | 3/1915 | Wadsworth | 126/361 |
| 1,786,453 | 12/1930 | Risdon | 126/120 |
| 2,541,245 | 2/1951 | Halmasy, Sr. | 126/350 |
| 2,671,440 | 3/1954 | Dudler | 126/127 |
| 3,385,651 | 5/1968 | Rasmussen et al. | 431/343 |
| 3,958,755 | 5/1976 | Cleer, Jr. | 126/132 |

*Primary Examiner*—John J. Camby
*Assistant Examiner*—Larry I. Schwartz
*Attorney, Agent, or Firm*—Cushman, Darby & Cushman

[57] ABSTRACT

A combinational fireplace arrangement has a plurality of log-shaped members having a hollow center portion with passageways through the bottom thereof for permitting air to pass upwardly through the log-shaped members into the hollowed center portion thereof. The log-shaped members also have a plurality of holes extending through the upper portion thereof from the hollowed center. A spiral shaped tube passes serially through each of the logs which tube conveys a fluid, such as water, through the log-shaped members. A fuel burning member, such as a gas burner, extends through the hollowed portion of each log-shaped member along the longitudinal axis defined by the spiral tubing. The fuel burner generates a flame which simultaneously heats the fluid passing through the spiral shaped tubing and generates a flame which passes upwardly through the holes to give the appearance that the log-shaped members are burning.

In an alternate embodiment of the invention, cylindrical members are utilized having the aforementioned structure with solid log-shaped members positioned on top thereof to give the appearance of burning logs while at the same time heating a fluid such as water passing through the center of the cylinders.

6 Claims, 8 Drawing Figures

COMBINATIONAL FIREPLACE UNIT

BACKGROUND OF THE INVENTION

This invention relates to an apparatus for efficiently heating a room or rooms while at the same time giving the aesthetic appearance of a plurality of logs burning in a fireplace.

In the past, a number of artificial fireplaces have been developed wherein gas or coal is burned with the flames thereof passing upwardly through and about non-combustible logshaped members. Examples of such fireplace arrangements are disclosed in the following U.S. Pat. Nos. 258,922, Holland; 464,457, Goetz et al.; 2,796,858, Carpenter; 3,227,149, Clark; 3,385,651, Rasmussen and 3,747,585, Coats.

In addition, fireplaces have been developed wherein water is heated simultaneously while generating a flame. An example of this type of arrangement is disclosed in Mershon U.S. Pat. No. Re. 5278 wherein a plurality of perforated metal logs are provided having a water pipe positioned on the outside thereof for conducting water therethrough. A source of energy, such as gas, is passed through an internal burner chamber with the exhaust gases passing out through the perforation in the metal logs to heat the water passing through the water pipe and at the same time to heat the air within a room. This arrangement, however, is not only inefficient but does not provide a pleasant appearance and accordingly, discourages those interested in conserving fuel, i.e., maximizing the efficiency of fuel, from utilizing such a fireplace arrangement.

In another development, Risdon, as disclosed in U.S. Pat. No. 1,786,453, provided a combination fireplace wherein water was passed through metal logs and then through coils for utilization in a radiator. The logs, however, did not have perforations therein for permitting exhaust gases burned inside the log to escape into the open fireplace. This arrangement was cumbersome, not aesthetically appealing and highly inefficient.

It accordingly is an object of this invention to provide an improved fireplace arrangement for simultaneously heating a fluid such as water and generating a flame to give the aesthetically pleasing appearance of a conventional fireplace.

It is another object of this invention to more efficiently utilize combustible fuel.

SHORT STATEMENT OF THE INVENTION

Accordingly, the present invention relates to a combinational fireplace arrangement wherein at least one log-shaped member has a hollowed center portion with means for transferring air from below the log-shaped member to the hollowed center portion. A spiral shaped tube extends substantially throughout the length of each of the logs and is joined together serially for conducting a fluid, such as water, therethrough. A fuel burning means, such as a gas burner, is passed through the center of the log-shaped members along the longitudinal axis defined by the spiral tubing. The burner generates a flame which is supported by air passing upwardly through the passages through the bottom of the log into the hollowed center portion thereof, with the flame heating the water passing through the spiral tubing and at the same time, passing upwardly through a plurality of holes in the upper portion of the log-shaped members to give the appearance of burning logs in a fireplace.

In an alternate embodiment of the invention, a plurality of cylindrical tubes has a plurality of holes formed in the top thereof together with passageways through the bottom thereof. Spiral tubing is positioned in the center of each of the cylinders, with the tubing being joined to one another serially. A gas burner is additionally positioned along the longitudinal axis defined by the spiral tubing within each of the cylinders for generating a flame for heating water or other fluid passing through the spiral tubing and for generating a flame which passes upwardly through the holes in the top of the cylinders, which flames pass upwardly and about artificial non-combustible logs to give the appearance of a burning fireplace.

BRIEF DESCRIPTION OF THE DRAWINGS

Other objects, features and advantages of the present invention will become more fully apparent from the following detailed description of the preferred embodiment of the invention, the appended claims and the accompanying drawings in which:

DETAILED DESCRIPTION OF THE PREFERRED EMBODIMENT

Figure 1:
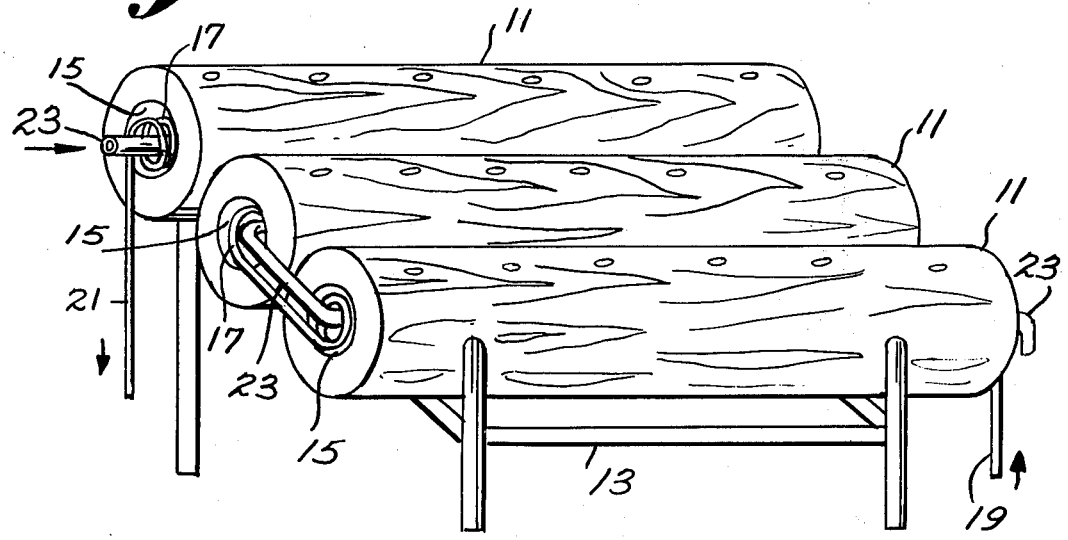
FIG. 1 is a perspective view of the combinational fireplace arrangement of the present invention.
Figure 2:
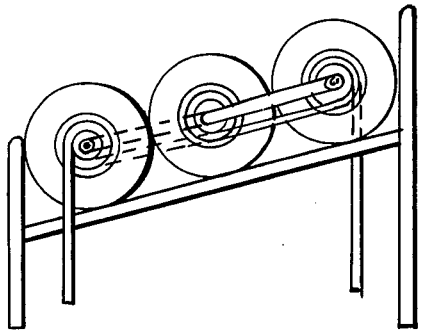
FIG. 2 is an end view of the fireplace arrangement of FIG. 1.

Refer now to FIGS. 1 and 2 where there is disclosed the preferred embodiment of the present invention. A plurality of log-shaped members 11 are positioned upon a support grill or frame 13 which may be of any conventional design known in the art. The log-shaped members 11 may be formed of any suitable non-combustible material such as, for example, ceramic materials and preferably are designed to give the appearance of natural logs. Each of the log-shaped members 11 has a hollowed center portion 15 for receiving a tubing of a highly heat-conducting material such as copper or steel. The tubing is formed in the shape of a spiral through substantially the entire length of the log-shaped members 11, which length ranges between twenty inches and less than six feet. The tubing after passing through one of the log-shaped members 11 then passes through in the opposite direction the next succeeding log-shaped member so that the tubing passing through each log-shaped member is serially connected to one another. A fluid such as water is passed through the tubing from inlet end 19 through to the outlet end thereof 21. Also positioned through the center of the hollowed portion of the logs 11 is a burner member 23 which may be of any conventional design. The burner preferably is passed continuously from one log through the center portion of another so that the burners are serially connected to one another. However, it should be understood that the burner members can be connected in parallel, if desired. The burner can carry, for example, natural gas or a liquid fuel which is burned in the hollowed center portion of the logs 11. As illustrated in FIG. 1, each of the logs has a plurality of holes extending upwardly from the hollowed portion 15 thereof to the top of the logs through which the flame and residual gases formed by the burning fuel of the burner is passed. The flames thus generated give the appearance that the logs are actually burning while at the same time heating the fluid, such as water, which passes through the spiral tubing 17.

If desired, the spiral tubing can be in the form of a closed loop wherein relatively cold water enters through opening 19, passes through the hollowed center portion of each of the logs and comes out through the exit end 21 of the tubing 17, heated to a desired level. The output end of the tubing 17 can be connected to a suitable distribution network so that the heated water can be coupled to radiators, a hot water storage tank or to other utilization devices as desired. Thus, with the fireplace arrangement of FIG. 1, not only is a pleasing appearance of a burning fireplace presented, but also hot water is provided for heating rooms in a house or other dwelling. Thus, the utilization of fuel, such as natural gas or liquid fuel, is efficiently used for a dual purpose.

Figures 3, 4, 5, 6:
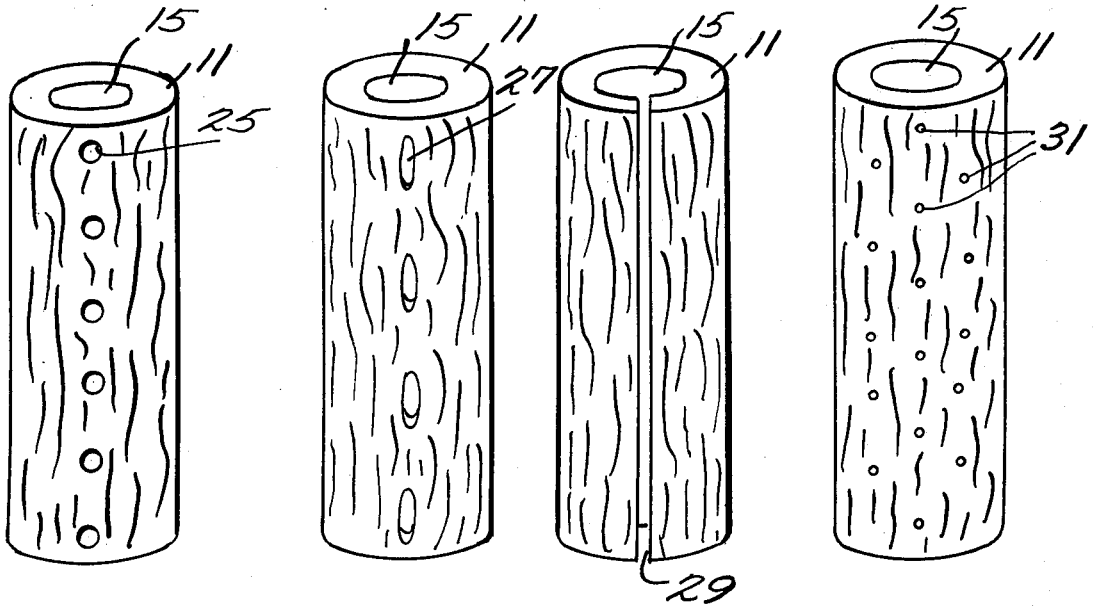
FIG. 3 is a view of the underside of the log-shaped members of FIG. 1.
FIG. 4 is an alternative embodiment of the underside of the log shaped members.
FIG. 5 is an alternative embodiment of the underside of the log shaped members.
FIG. 6 is a view of the top of the logs of FIG. 1.

Refer now to FIG. 3 where there is illustrated the bottom side of the logs 11 showing a plurality of vent holes 25 therethrough for permitting air to pass upwardly through the log into the hollowed portion 15 thereof. The vent holes provide combustible fuel, i.e., oxygen, to the fuel burner 23 so that the fuel being burned is burned efficiently to thereby prevent the generation of harmful exhaust emissions such as, for example, carbon monoxide. Preferably, the holes are 1 inch in diameter. However, they may be of any suitable size desired for providing a substantially complete combustion of the fuel within the hollowed portion 15 of the logs 11.

Refer now to FIG. 4 which shows an alternate embodiment of the bottom of the logs 11 wherein oval or oblong shaped holes 27 are provided therein. The holes 27 are for the same purpose as the holes 25 of FIG. 3, namely, to permit air to pass therethrough to enable the complete combustion of the fuel within the hollowed portion 15 of the logs. In the preferred embodiment, the holes 27 are $1 \times 2$ inches, however, they may be of any suitable size desired. In practice, it has been found that the log structure of FIG. 4 is preferable when liquid fuel is being burned by the burners 23 and the circular hole shape of FIG. 3 is most suitable when natural gas is being burned within the hollowed portion of the log.

Refer now to FIG. 5 where a horseshoe shaped log structure is provided. A slit 29 is provided which extends the length of the log for the purpose of permitting air to pass upwardly through the log into the hollowed center portion thereof. This structure has been found to be most suitable when solid fuels are burned within the log. Thus, when solid fuels are burned, it is important that air makes contact over substantially all of the surface area of the fuel and accordingly this structure enables such a transferral of combustible oxygen to the solid fuel.

Refer now to FIG. 6 where there is disclosed a more specific structure for the top of the logs 11. As illustrated, a plurality of apertures or holes are provided in the logs which holes extend through the logs to the hollow center portion 15 thereof. The holes 31 provide for passage of the flame generated within the inside of the log outwardly of the log to give the appearance that the log is burning.

Figure 7:
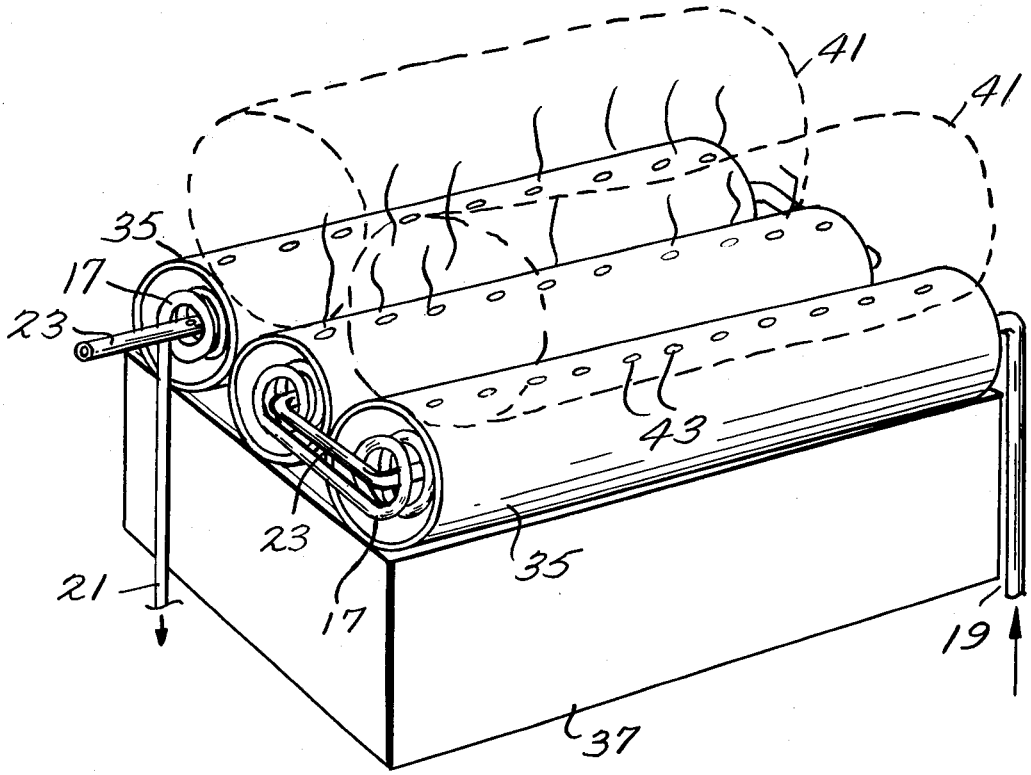
FIG. 7 is an alternate embodiment of the invention utilizing cylindrical tube-shaped members.

Refer now to FIG. 7 where there is disclosed an alternate embodiment of the present invention. As illustrated, a plurality of cylindrically shaped tubes 35 are each positioned on a support frame 37 which may be in the form of a box, as illustrated, or may be in the form of grids or a frame structure as illustrated in FIG. 1. The cylinders 35 may be formed of any suitable material such as steel or aluminum, with each of the cylinders having a plurality of holes through the top thereof and a corresponding plurality of holes through the bottom thereof. As in the first embodiment, a tube 17 is formed in the shape of a spiral tubing as it passes through each of the cylinders 35. The tubing 17 passes through a first cylinder in one direction and then in the opposite direction through the next succeeding cylinder so that each spiral section of the tubing is serially connected to the previous spiral section. A fluid, such as water, is passed through the tubing from inlet end 19 through to the outlet end 21 for the purpose of heating the fluid for utilization in heating a room or rooms, or for storage in a hot water tank. In addition, a gas burner 23 extends through each of the cylinders with the gas burner preferably connected serially to form a single continuous path from inlet to outlet. However, it should be understood that the gas burners 23 can be connected in parallel if desired.

As illustrated in phantom, non-combustible log-shaped members 41 are positioned on top of the cylinders 35 to give the appearance of logs in a fireplace. As gas or liquid fuel is passed through the burners 23, the gas is burned thereby generating flames which heat the fluid passing through the spiral tubing 17 while, at the same time, generating flames which pass upwardly through holes 43 in the cylinders 35 and about the logs 41 to give the appearance that the logs 41 are on fire. Thus, with the embodiment of FIG. 7, fuel is advantageously burned to not only provide an aesthetic appearance of a fireplace but also to heat water which can be utilized to heat the outer extremities of the room in which the fireplace is positioned and/or to heat other rooms in the dwelling.

Figure 8:
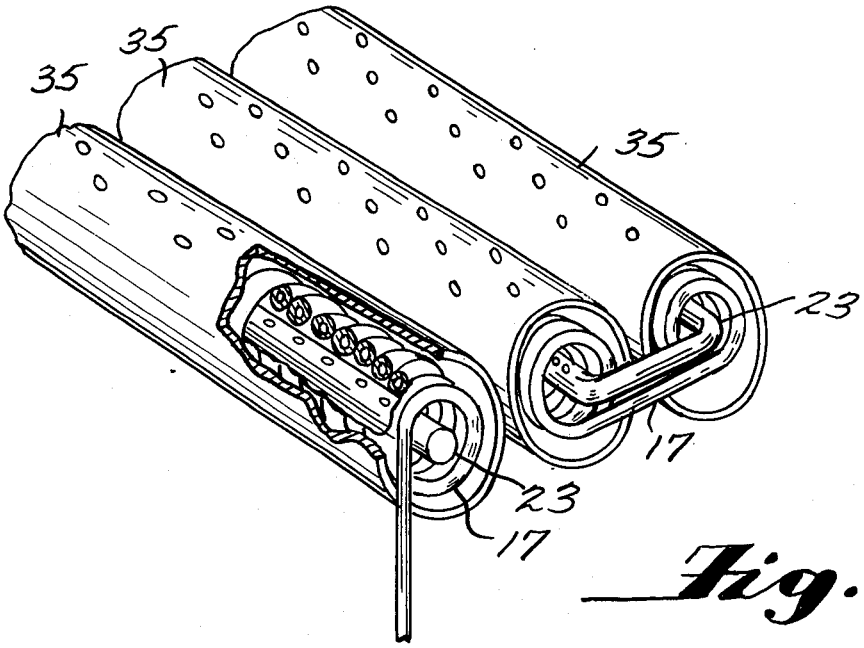
FIG. 8 is a partial perspective view of the fireplace structure of FIG. 7.

Refer now to FIG. 8 which is a partial perspective view showing a partial cutaway of the cylinder, burner arrangement of FIG. 7. The cylinders 35 are shown having the cylindrical tubing 17 passing therethrough in such a manner that each of the spiral portions of the tubing are connected serially to one another. In addition, a liquid or gas burner 23 extends through the cylinders 35 and along the longitudinal axis defined by the spiral tubing 17 in each of the cylinders. Preferably the burners are joined to one another at the respective ends to form a serial gas burner arrangement. However, as aforementioned, the gas or liquid fuel burners 23 can be connected in parallel if desired. The holes 43 shown in the top of the cylinders 35 are for the purpose of permitting the egress of residual gases formed within the cylinder 35 during the burning process while at the same time permitting the flames generated therein to pass upwardly through the hose and about the logs 41. Not illustrated is a bottom structure of the cylinders 35 which is similar to the bottom structure of the logs 11 of the first embodiment wherein holes are formed to permit the passage of a combustible material such as oxygen into the center portion of the cylinders 35.

While the present invention has been disclosed in connection with a preferred embodiment thereof, it should be understood that there may be other alternate embodiments which fall within the spirit and scope of the invention as defined by the appended claims.

What is claimed is:

1. A combinational fireplace arrangement comprising at least one log-shaped member having a hollowed center portion and having means for transferring air from below the log-shaped member to said hollowed center portion thereof and having aperture means extending from said hollowed center portion to the outside of said log-shaped member proximate the top thereof, means for supporting said at least one log, a spiral shaped tube extending within the hollowed center portion and substantially throughout the length of said at least one log, and a fuel burning means extending along the longitudinal axis defined by said spiral tubing, said fuel burning means heating a fluid passing through said spiral tubing while at the same time generating the flame which passes through said apertures upwardly away from said log-shaped member to give the appearance of a burning log.

2. The combinational fireplace arrangement of claim 1 wherein a plurality of log-shaped members are provided and wherein said spiral shaped tubing passing through the length of each log is serially connected to one another to form a continuous path for fluid conducted by said tubing.

3. The combinational fireplace arrangement of claim 2 wherein said heated fluid is coupled to a radiator for heating an area.

4. The combinational fireplace arrangement of claim 2 wherein said heated fluid is stored.

5. A combinational fireplace arrangement having at least one hollow cylinder, said cylinder having means for transferring air from below said cylinder to the center portion thereof and having aperture means extending from the center thereof to the outside proximate the top thereof, means for supporting said at least one cylinder, a spiral shaped tube extending within and substantially throughout the length of said at least one cylinder, a fuel burning means extending along the longitudinal axis defined by said spiral tubing, said fuel burning means heating a fluid passing through said spiral tubing while at the same time generating a flame which passes upwardly through said apertures, and at least one non-combustible log positioned with respect to said cylinder, said flame passing upwardly from said cylinder about said log to give the appearance of said log burning.

6. The combinational fireplace arrangement of claim 5 comprising a plurality of cylinders positioned next to one another and wherein said spiral tubing is connected serially to one another to form a continuous path for fluid passing therethrough.

* * * * *